US009598883B1

(12) United States Patent
Avganim

(10) Patent No.: US 9,598,883 B1
(45) Date of Patent: Mar. 21, 2017

(54) SECURITY DEVICE FOR PORTABLE OBJECTS

(71) Applicant: Alexander Gad Avganim, Tel Aviv (IL)

(72) Inventor: Alexander Gad Avganim, Tel Aviv (IL)

( * ) Notice: Subject to any disclaimer, the term of this patent is extended or adjusted under 35 U.S.C. 154(b) by 0 days.

(21) Appl. No.: 14/833,293

(22) Filed: Aug. 24, 2015

(51) Int. Cl.
*E05B 73/00* (2006.01)
*E05B 67/38* (2006.01)

(52) U.S. Cl.
CPC ..... *E05B 73/0082* (2013.01); *E05B 67/383* (2013.01); *E05B 73/0005* (2013.01)

(58) Field of Classification Search
CPC ..... E05B 67/383; E05B 73/0005; E05B 73/0082; E05B 37/025
USPC ..... 70/14, 58; 248/551–553; 361/679.57
See application file for complete search history.

(56) References Cited

U.S. PATENT DOCUMENTS 3,859,826 A * 1/1975 Singer ..... E05B 73/0005 70/371
4,733,840 A * 3/1988 D'Amore ..... E05B 73/0005 248/205.3
5,154,456 A * 10/1992 Moore ..... E05B 73/0082 248/552
5,361,610 A * 11/1994 Sanders ..... G11B 33/005 248/552
5,406,809 A * 4/1995 Igelmund ..... E05B 73/0005 248/552
5,446,618 A * 8/1995 Tetsuya ..... E05B 73/0005 292/148
5,447,045 A * 9/1995 Cheng ..... E05B 73/0005 248/552
5,709,110 A * 1/1998 Greenfield ..... E05B 73/0005 248/553
6,178,089 B1 * 1/2001 Alfonso ..... E05B 73/0005 361/727
6,578,394 B2 * 6/2003 Yin ..... E05B 73/0005 248/551
6,742,366 B1 * 6/2004 Lai ..... E05B 37/025 70/30
7,565,824 B1 * 7/2009 Gleason ..... E05B 73/0005 248/552
7,639,133 B1 * 12/2009 Kelsch ..... G08B 13/1445 340/545.6
7,654,120 B1 * 2/2010 Chen ..... E05B 73/0005 248/553
8,107,236 B2 * 1/2012 Lin ..... E05B 73/0082 248/551
8,111,511 B2 * 2/2012 Ruch ..... E05B 73/0082 248/166

(Continued)

*Primary Examiner* — Suzanne Barrett
(74) *Attorney, Agent, or Firm* — Henry M. Sinai; IP-Partnership

(57) ABSTRACT

A security device fitted to the base casing of a portable object for securing the portable object is provided. The security device includes a housing having an indentation formed within one face of the housing and a retractable tongue pivotably mounted at one end within the indentation. The tongue has an aperture formed within the tongue's non-pivotal end. In a first mode, the retractable tongue is storable within the indentation and in a second mode, the retractable tongue may be extended beyond the contours of the device allowing for a secondary component to be attached to the aperture.

4 Claims, 4 Drawing Sheets

(56) References Cited

U.S. PATENT DOCUMENTS

| | | | | |
|---|---|---|---|---|
| 8,456,836 | B2 * | 6/2013 | Allen | E05B 73/0082 211/8 |
| 8,869,573 | B2 * | 10/2014 | Myers | E05B 73/0005 70/14 |
| 2012/0222458 | A1 * | 9/2012 | Avganim | B41J 29/023 70/58 |

* cited by examiner

SECURITY DEVICE FOR PORTABLE OBJECTS

CROSS REFERENCE TO RELATED APPLICATIONS

This application claims the benefit of U.S. provisional patent application No. 62/041,714, filed on Aug. 26, 2014 and incorporated by reference as if set forth herein.

FIELD OF THE INVENTION

The present invention generally relates to security devices, and specifically to devices for securing a portable object, such as a laptop computer and tablets.

BACKGROUND OF THE INVENTION

The use of smaller portable computer devices such as laptops, notebooks and tablets has been increasing over the years and is now commonplace. The advantage of these devices being relatively small and easily transportable, unfortunately has the undesirable side effect of making them easier targets for thieves.

This has become a significant problem, which a led to the development of a variety of devices which inhibit their theft. Commonly, security systems often employ a cable, which attaches to the mobile equipment to a relatively immovable object such as a desk or table leg.

Some systems utilize a security apparatus having a locking head, which may be secured to the computer via a rectangular slot, provided in a wall of a computer, for example. A disadvantage of this type of device is that the user needs to align the locking head with the slot, and then turn a key to rotate a T-bar to a locked configuration. This takes a number of steps and requires a fair amount of effort on the part of the user.

Other security devices include lid locks, and lockable docking stations, which secure the laptop computer to a working surface or another object, and utilize keys or other numeric combination style mechanisms to permit authorized access to unlock the computer. These security devices, however, can typically be circumvented) by brute force techniques.

Alternative systems use devices, which lock the computer lid to the base, preventing the computer from being used. The device may also connectable to a non-movable object preventing theft.

The prior art devices tend to be bulky and inconvenient to use and if fixed permanently to the computer make the computer unstable in use as well as being aesthetically displeasing.

SUMMARY OF THE INVENTION

Thus, there is provided, in accordance with an embodiment of the invention, a security device fitted to the base casing of a portable object for securing the portable object. The security device includes a housing having an indentation formed within one face of the housing and a retractable tongue pivotably mounted at one end within the indentation. The tongue has an aperture formed within the tongue's non-pivotal end. In a first mode, the retractable tongue is storable within the indentation and in a second mode, the retractable tongue may be extended beyond the contours of the device allowing for a secondary component to be attached to the aperture.

Furthermore, the security device further includes a securing element attached to the retractable tongue to hold the retractable tongue in its first mode when pushed in place and the locking element may be released from its secured position when pressure is exerted against the retractable tongue.

Furthermore, the security device further includes a securing component attachable to the aperture. The securing component may include any of group of locking devices including T-bar, scissors design, padlocks and combination locks.

BRIEF DESCRIPTION OF THE DRAWINGS

The present invention will be understood and appreciated more fully from the following description taken in conjunction with the appended drawings in which.

DESCRIPTION OF THE PREFERRED EMBODIMENTS

The present invention relates to a security (or anti-theft) device, which may be used in conjunction with an independent locking mechanism for preventing the theft of portable devices, such as laptop computers, tablets and other mobile devices.

Reference is now made to FIGS. 1A-1E and FIGS. 2-7, which schematically illustrate the security device, generally designated 10, constructed and operative in accordance an embodiment of the invention. Device 10 is configured to fit to the underside (or base) of a mobile device (see FIGS. 4-7). For exemplary purposes only, device 10 is shown affixed to a laptop computer 12, but it will be appreciated that the dimensions and configuration of device 10 may be modified and affixed to any portable device of any size.

Figure 1A:
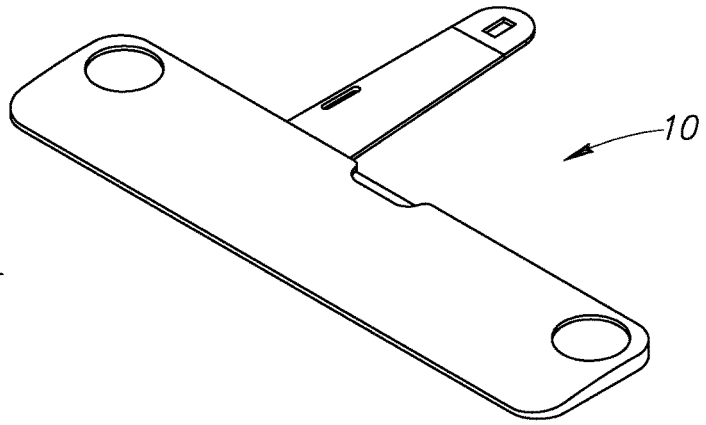
FIG. 1A is a schematic perspective view of a security device constructed and operative in accordance an embodiment of the invention.
Figure 1B:
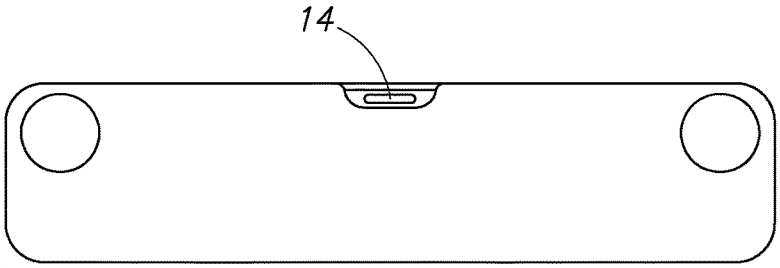
FIG. 1B is a schematic top view of the security device of FIG. 1A.
Figure 1C:
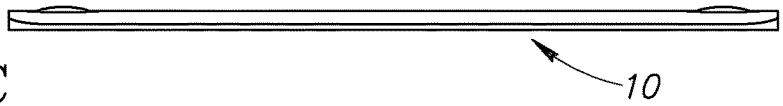
FIG. 1C is a schematic side view of the security device of FIG. 1A.
Figure 1D:
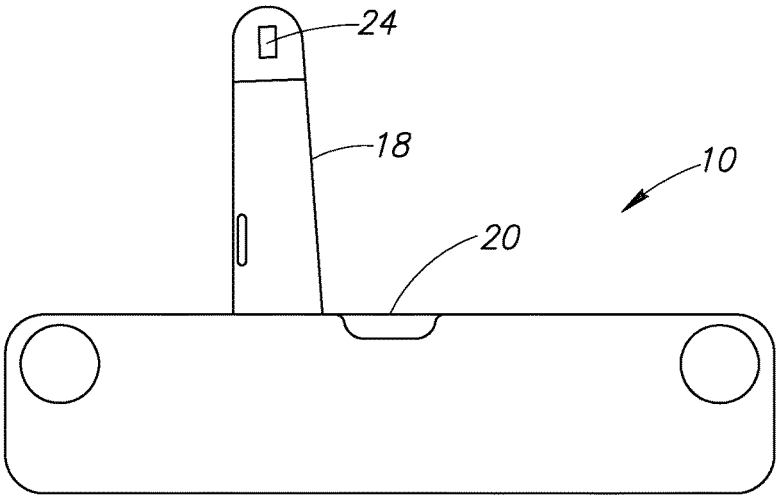
FIG. 1D is a schematic top view of the security device of FIG. 1A, showing the locking tongue associated with the security device of FIGS. 1A-1E.
Figure 3:
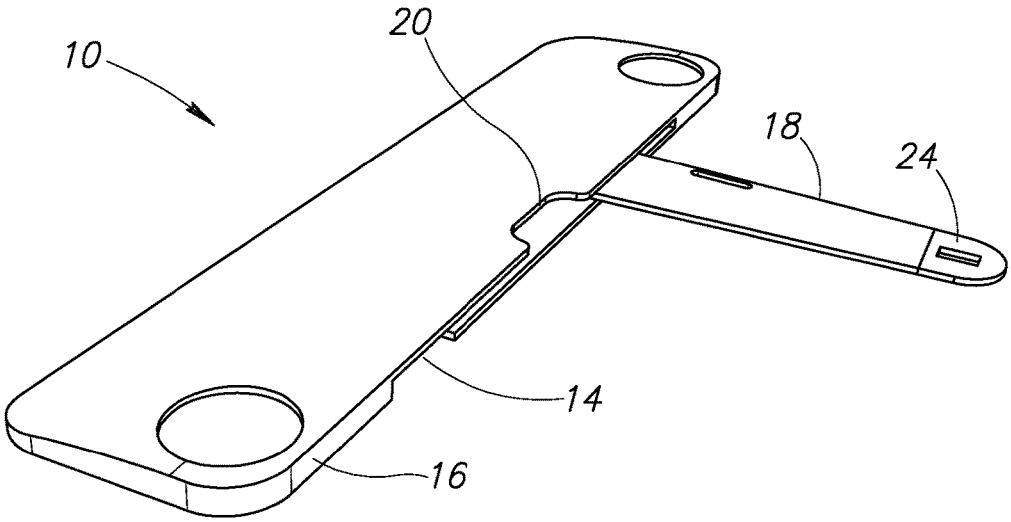
FIG. 3 is a schematic view of the top of the security device of FIG. 1A.

In one embodiment of the invention, device 10 has a generally rectangular configuration with a generally triangular cross-section (see FIGS. 1A, 3). This configuration, which is suitable for a laptop computer, as shown in FIGS. 4-7, is particularly comfortable for the user. The security device, which is hidden from view while the computer is being used, is also aesthetically pleasing. Preferably, the device is permanently attached to the underside of the mobile device using any suitable adhesive, known in the art.

Device 10 comprises a housing having a first indentation 14 formed within a side wall 16 of the device 10. The device is preferably manufactured from a flexible yet durable and strong material, which, though flexible prevents it being broken by brute force. A retractable tongue 18 is pivotably mounted at one end, within the indentation 14. Thus, when not in use, retractable tongue 18 may be neatly stored (see FIG. 2), which is ideal when carrying or moving the portable device. The retractable tongue 18 extends beyond the contour of the device itself. In an alternative embodiment, the device 10 may be configured so that the retractable tongue 18 extends from the side of the device in a push-pull mode, which may be assisted by a spring-like element known in the art.

Figure 2:
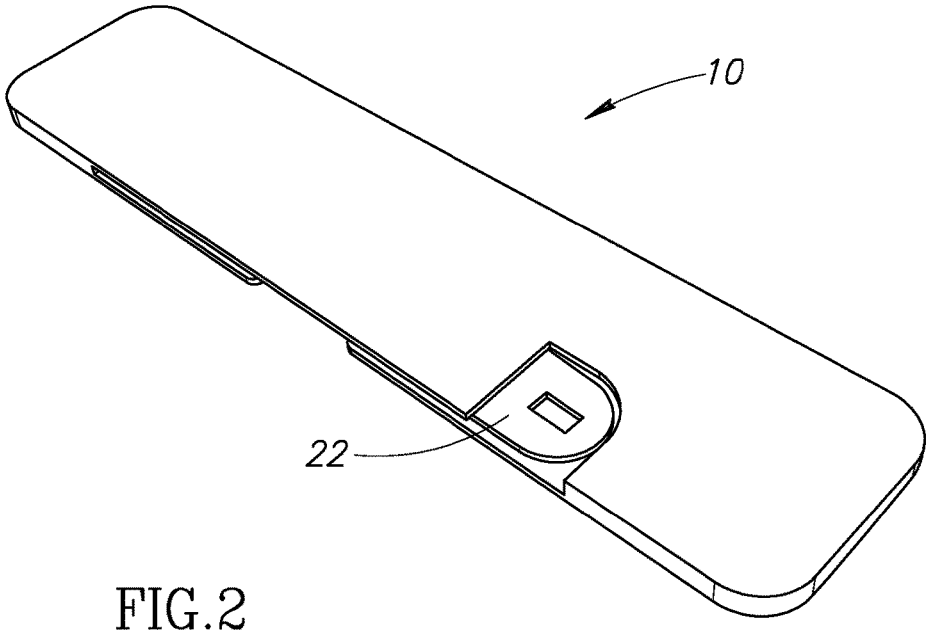
FIG. 2 is a schematic view of the base of the security device of FIG. 1A.
Figure 4:
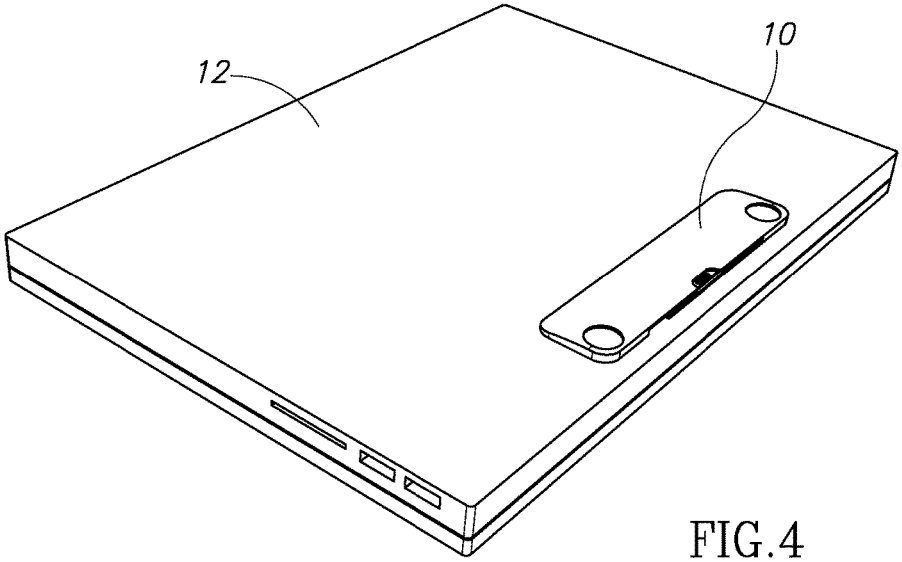
FIG. 4 is an illustration of the security device of FIGS. 1A-1E attached to the underside of a laptop computer.
Figure 5:
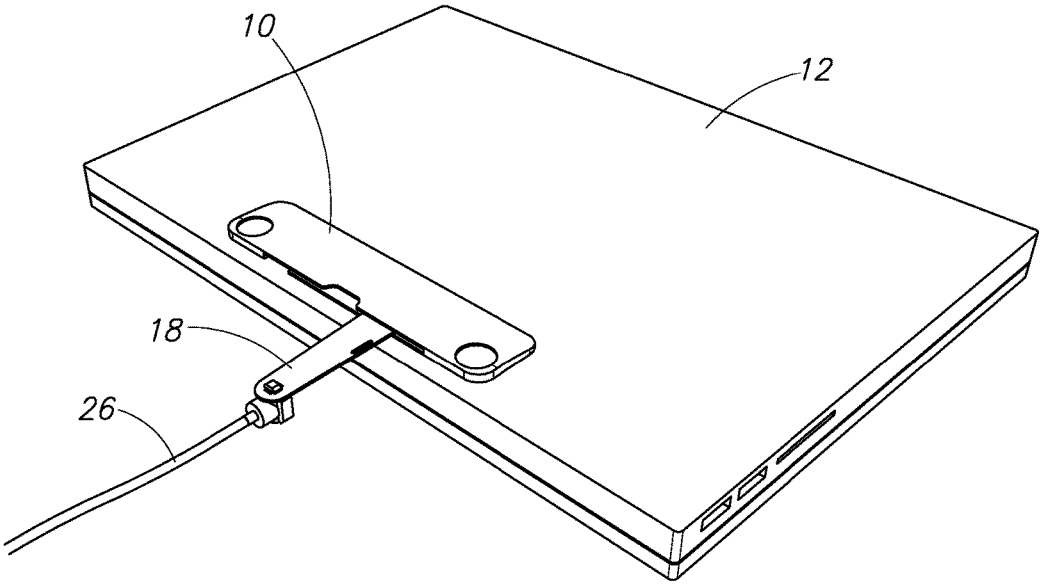
FIG. 5 is an illustration of the security device of FIGS. 1A-1E attached to the underside of a laptop computer with the locking tongue extending from the base plate.
Figure 6:
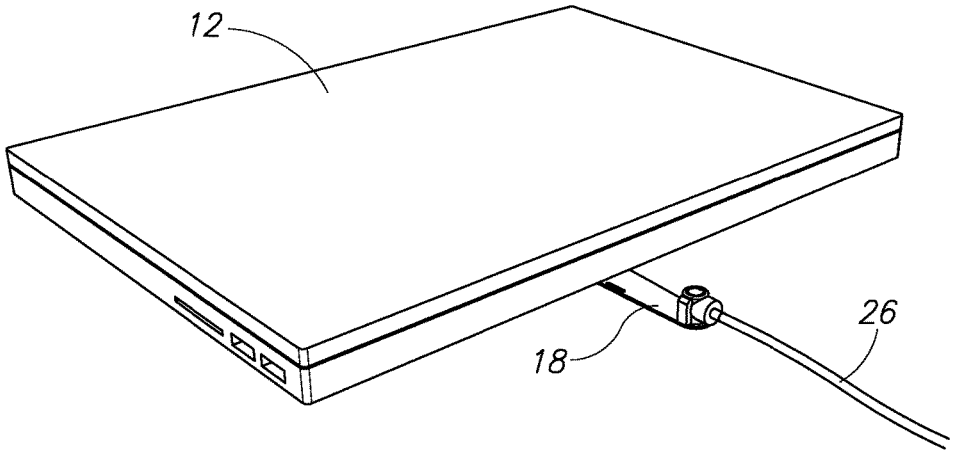
FIG. 6 is a top view illustration of a closed laptop computer with the locking tongue attached to a locking device.
Figure 7:
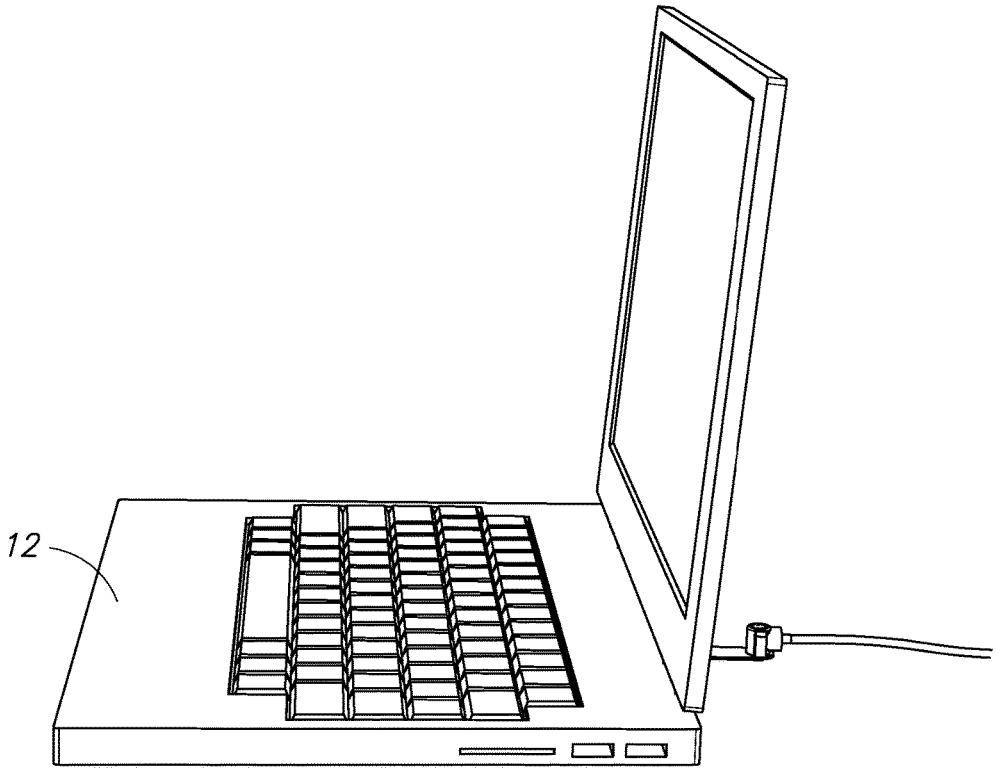
FIG. 7 is a top view illustration of the laptop computer of FIG. 4 in normal working mode.

The device 10 further comprises a second indentation 20 on its exposed side (that is the on the side which is visible when the computer 12 is viewed from the bottom (FIGS. 4 & 5). A second indentation 22 may be formed on the hidden side (FIG. 2). The second indentation 22 allows the user to pull out the blade/tongue easily by using his thumb.

In an embodiment of the invention, the retractable tongue 18 may comprise an aperture 24 formed therewithin, at it's (non-pivotal) end to allow for connecting a suitable locking device such as a cable 26 (for example) or other locking device for securing the computer (FIGS. 3-5). The aperture 24 may be configured to any dimensions.

As shown (FIG. 2), the device 10 may be fixed by any suitable means, to the underside of a mobile device, such as computer 12. It will be appreciated that the device 10 may be fixed in any location on the underside of the computer in any orientation (longitudinal, transverse or diagonal, for example).

In an alternative embodiment, the retractable tongue 18 may comprise a a securing component, such as a knob-like fitting (or any other fitting) configured to fit within the first indentation of the security device. Thus, the security device may be attached to any type of security lock. including T-bar, scissors design, padlocks and combination locks.

In the embodiment shown, the device 10 may be fixed on a longitudinal axis, close to the back of the computer. In this position, the computer is stable both when closed (FIG. 4) and open in working mode (FIG. 5). In working mode the device and lock do not interfere with the use of the computer.

It will be appreciated that the present invention is not limited by what has been described hereinabove and that numerous modifications, all of which fall within the scope of the present invention, exist.

Rather the scope of the invention is defined by the claims, which follow:

1. A security device for securing a portable object, the security device configured to be attachable to the underside of the portable object, wherein the device comprises:

a housing having an indentation formed within one face of the housing; and a retractable tongue pivotably mounted at one end within the indentation, said tongue having an aperture formed within the tongue's non-pivotal end;

whereby in a first mode, the retractable tongue is storable within the indentation and in a second mode, the retractable tongue may be extended beyond the contours of the device allowing for a secondary component to be attached to said aperture;

wherein the device has a generally rectangular configuration with a generally triangular cross-section, thereby elevating the portable object to an inclined position.

2. The security device of claim 1, wherein the device further comprises a securing element attached to the retractable tongue to hold the retractable tongue in its first mode when pushed in place and wherein said securing element is released from its secured position when pressure is exerted against the retractable tongue.

3. The security device of claim 1, wherein the device further comprises a securing component attachable to the aperture.

4. The security device of claim 1, wherein the securing component comprises any of group of locking devices including T-bar, scissors design, padlocks and combination locks.

* * * * *